United States Patent [19]

Hahn et al.

[11] 4,343,174

[45] Aug. 10, 1982

[54] BEADING DIE FOR CAN BODIES

[75] Inventors: Kurt L. Hahn, San Rafeal; Howard J. Padgett, Sunnyvale, both of Calif.; Manjeshwar S. Rao, Hoffman Estates, Ill.

[73] Assignee: American Can Company, Greenwich, Conn.

[21] Appl. No.: 90,498

[22] Filed: Nov. 1, 1979

[51] Int. Cl.[3] ..... B21D 22/00

[52] U.S. Cl. ..... 72/349; 72/348; 72/402

[58] Field of Search ..... 72/349, 370, 355, 385, 72/399, 402, 389, 348; 113/120 M, 120 W, 113 AA, 1 G

[56] References Cited

U.S. PATENT DOCUMENTS

| | | | |
|---|---|---|---|
| 2,198,873 | 4/1940 | Hinsdale | 72/355 |
| 2,313,749 | 3/1943 | Hothersall | 113/120 M |
| 3,222,910 | 12/1965 | Paper | 72/399 X |
| 3,315,626 | 4/1967 | Bofinger | 113/120 W X |
| 3,726,121 | 4/1973 | Arnold et al. | 72/402 |
| 3,855,862 | 12/1974 | Moller | 72/349 X |
| 3,952,575 | 4/1976 | Starza | 72/370 |

*Primary Examiner*—Leon Gilden

*Attorney, Agent, or Firm*—Paul R. Audet; Stuart S. Bowie; W. C. Hosford

[57] ABSTRACT

A metal forming tool useful to form internal and external impressions of various configurations upon two piece can bodies of round, oval, triangular, rectangular or irregular and unsymmetrical cross-section.

2 Claims, 12 Drawing Figures

BEADING DIE FOR CAN BODIES

BACKGROUND OF THE INVENTION

The present invention relates to metal working and in particular relates to metal can making.

The invention is especially useful in the manufacture of so called "two piece" cans. The language two piece is intended to denote cans having a top or closure fabricated from one piece of sheet metal and having a body and a contiguous bottom fabricated from a second piece of sheet metal.

More specifically, the invention relates to tools and dies useful to form peripheral chimes and beads and other impressions of various configurations upon can bodies in automatic fashion.

In prior art devices beads were added to round can bodies by a rolling action in which a can body was sandwiched between cooperating male and female rolling dies and a bead was worked into the can as the dies rolled about the can body. Alternatively, beads were formed by dies working through the open ends of a three piece (top, bottom and side walls made from separate blanks) can.

Prior art devices are shown in the following U.S. Pat. Nos. 1,740,196 to Muhlbach, 2,198,873 to Hinsdale, 2,313,749 to Hothersall, 2,579,919 to Funke, 3,726,121 to Arnold et al and 3,855,862 to Moller.

A particular feature of the present invention is the provision of a metal working tool useful to form body beads and chime beads in a two piece metal can of circular, rectangular, oval, triangular or irregular and unsymmetrical cross-section.

A further feature of the invention is the provision of a metal working tool useful to form random or regular impressions of any, desired configuration upon the body of a two piece can of circular, rectangular, oval, triangular or irregular and unsymmetrical cross-section.

A still further feature of the invention is the provision of a metal working tool useful to form internal (inwardly projecting relative to the can body sidewall) and external (outwardly projecting) impressions of any desired configuration.

A further feature of the invention is the provision of a plurality of groups or sets of segmental dies which are operative to move to and fro relative to a work piece (can body) in sequential fashion.

A further feature of the invention is the provision of a novel metal working tool including a plurality of segmental die sets which operate upon the interior and upon the exterior of a can body sequentially.

The working surfaces of said segmental dies correspond generally to the cross-sectional configuration of the can body. For example, if the can body is oval the working surfaces define an oval.

Note, too, that the scope of the present invention includes realization that the die segments of a given set may vary in number as considerations of good design dictate. For example, a set may be composed of two, three, four or more die segments as mechanical design considerations require.

A still further feature of the invention is the provision of a metal working tool which lends itself to inclusion, as an additional work station, in a conventional can press thereby precluding transfer of a finished can to a separate multiple head bead rolling tool for the beading operation.

A further feature of the invention is the provision of a metal forming tool operative to form a wide variety of beads or embossments upon a two piece metal can body. The language "beads" or "embossments" is intended to denote concave or convex impressions upon can bodies having round, rectangular, oval, triangular or irregular and unsymmetrical configuration in cross-section.

For example, die segments can be employed which create circular, vertical, spiral, inter-secting, random or patterned impressions upon a can body projecting to the interior or to the exterior of the can body wall as desired.

A further feature of the invention is the provision of a metal forming tool useful in the can making art operative to make random or regular impressions upon a can body where the impressions are effective to increase the can body's resistance to identation, crushing or axial compression.

A further feature to the invention is the provision of a metal working tool in the can making art operative to increase the structural integrity of the can body thereby facilitating the use of thinner gage can making stock than would be necessary in the absence of the present invention.

A still further feature of the invention is the provision of a metal working tool which precludes damage to coatings previously applied on one or both sides of a work piece.

Another feature of the invention is the provision of a metal working tool of the general class discussed above which facilitates changes in die sets when it is desired to change impressions or patterns of impressions.

SUMMARY OF THE INVENTION

A metal working tool useful to form pre-determined shapes in sheet metal structure embracing certain features of the present invention may comprise a plurality of sets or groups of segmental external dies and a cooperating set of segmental internal dies, said sets of dies being moveable from a first position defining an open or work receiving position to a second position in which one set of external dies cooperates with said internal segmental dies to perform a first metal forming operation, said sets of dies being further operable to assume a third position in which a second set of external dies cooperates with said internal dies to perform a second metal forming operation and cam means moveable through a pre-determined stroke cooperating with all said sets of dies operative to drive said dies sequentially from said first position to said second position and ultimately to said third position.

A process for practicing the principles of the present invention upon a two-piece can body may comprise the steps of disposing the can body between at least two sets of die segments, said die segments being formed with surface contours calculated to create desired impressions, and moving said sets of die segments toward the can body and toward one another while retaining said can stationary effective to form impressions upon said body consistent with said surface contours.

Other features of the present invention will become more apparent upon an examination of the succeeding specification when read in conjunction with the appended drawings, in which;

DESCRIPTION OF THE DISCLOSED EMBODIMENT OF THE INVENTION

Figure 1:
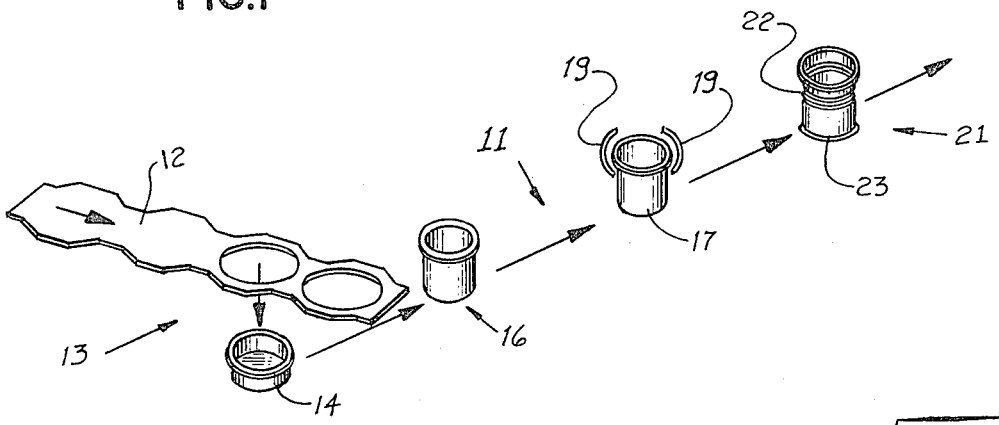
FIG. 1 is a schematic illustration of a can press and the process steps practiced in a single can press including a station showing the metal working tool of the present invention.

Referring now in detail to the drawings and in particular to FIG. 1, the reference numeral 11 designates schematically a two piece can press and the sequence of operations in such a can line where all operations are incorporated in a single can press and in which a metallic strip 12 is advanced sequentially in the direction shown by the arrow to a blank and draw station 13 to form cup 14. Cup 14 is advanced to redraw station 16 where the cup is drawn further and/or "ironed" to generate a taller and smaller diameter cup or can 17. Next the can 17 is advanced to a trim station 18 where trim scrap 19—19 is removed. Thereafter, within the same can making unit or press 11 the can 17 is advanced to a beading station 21 where a plurality of sets of internal and external segmental dies form impressions on the can body as at 22 or upon the chime as at 23 in a manner which will be more apparent as the specification proceeds.

Figure 2:
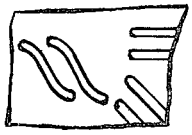
FIG. 2 is a representation, somewhat enlarged, of a sidewall of a metal container illustrating representative impressions that may be embossed utilizing the present invention.

It is to be particularly noted that the metal working tool of the present invention is operative to produce any desired pattern of impressions upon the can body as indicated in a portion of a can body shown enlarged in FIG. 2.

Furthermore, the present invention is useful to create impressions upon a can body of rectangular, oval, triangular or other irregular and unsymmetrical cross-section.

Figure 4:
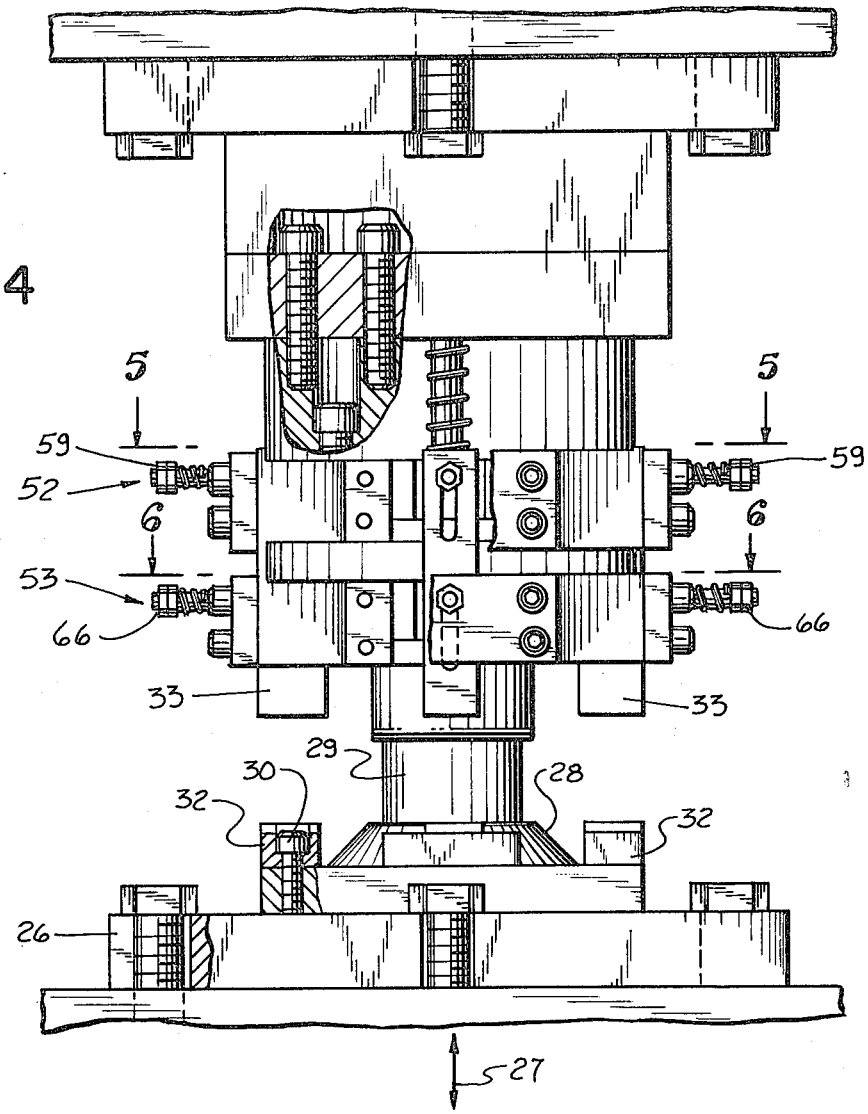
FIG. 4 is a side elevational view of a metal working tool embracing the principles of the present invention.
Figure 5:
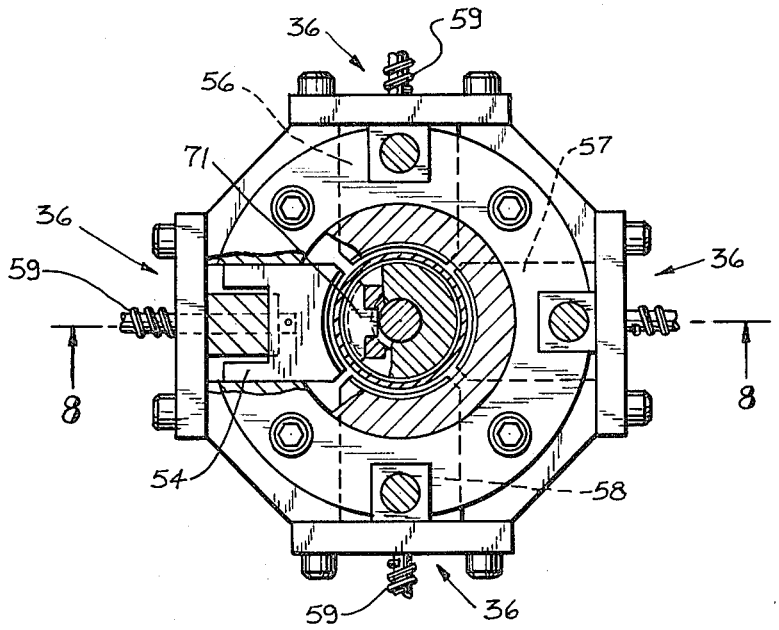
FIG. 5 is a sectional view of FIG. 4 as viewed in the plane represented by the line 5—5 and in the direction of the arrows.
Figure 6:
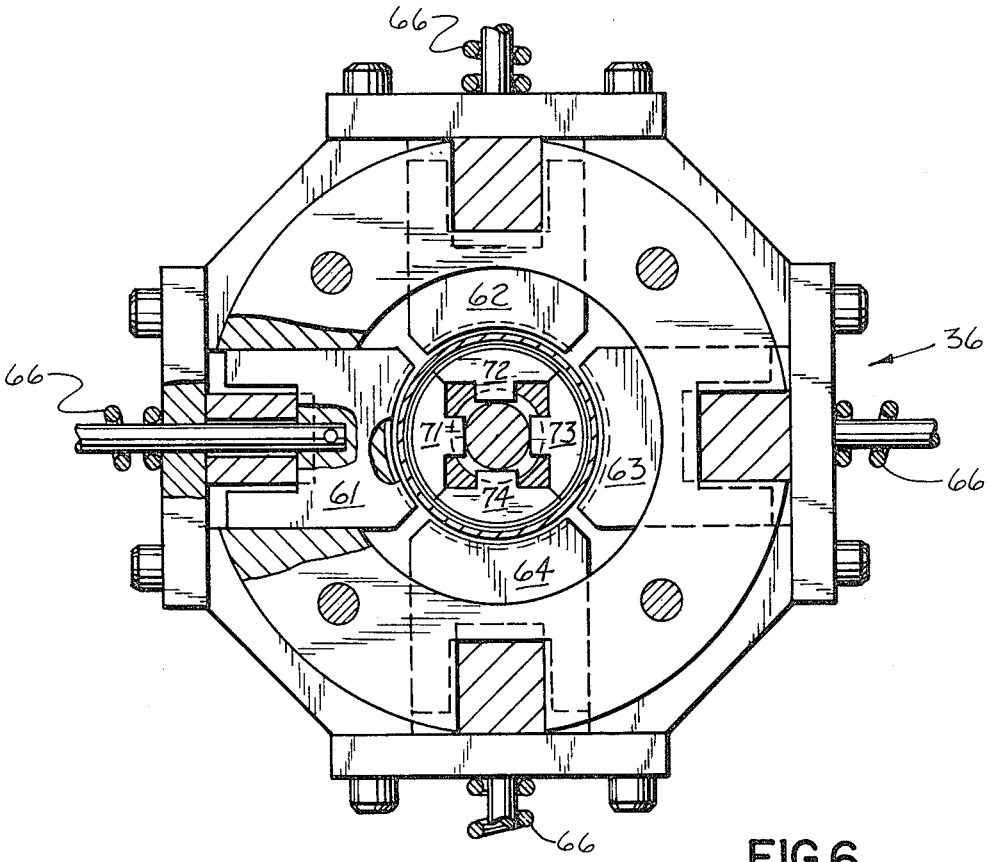
FIG. 6 is a sectional view of FIG. 4 as viewed in the plane represented by the line 6—6.
Figure 7:
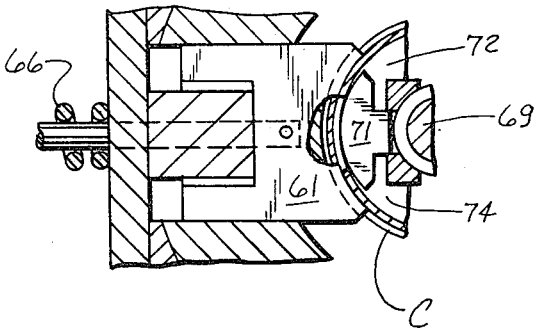
FIG. 7 is a view of a portion of FIG. 6 showing the chime forming dies in the operated position.

Referring now to FIGS. 4 through 9, the metal forming tool of the present invention includes a base 26 powered (by means not shown) to reciprocate vertically as indicated by the arrow 27 of FIG. 4.

Socket 28, secured to base 26 slideably receives support 29 providing a seat for can C.

Figure 8:
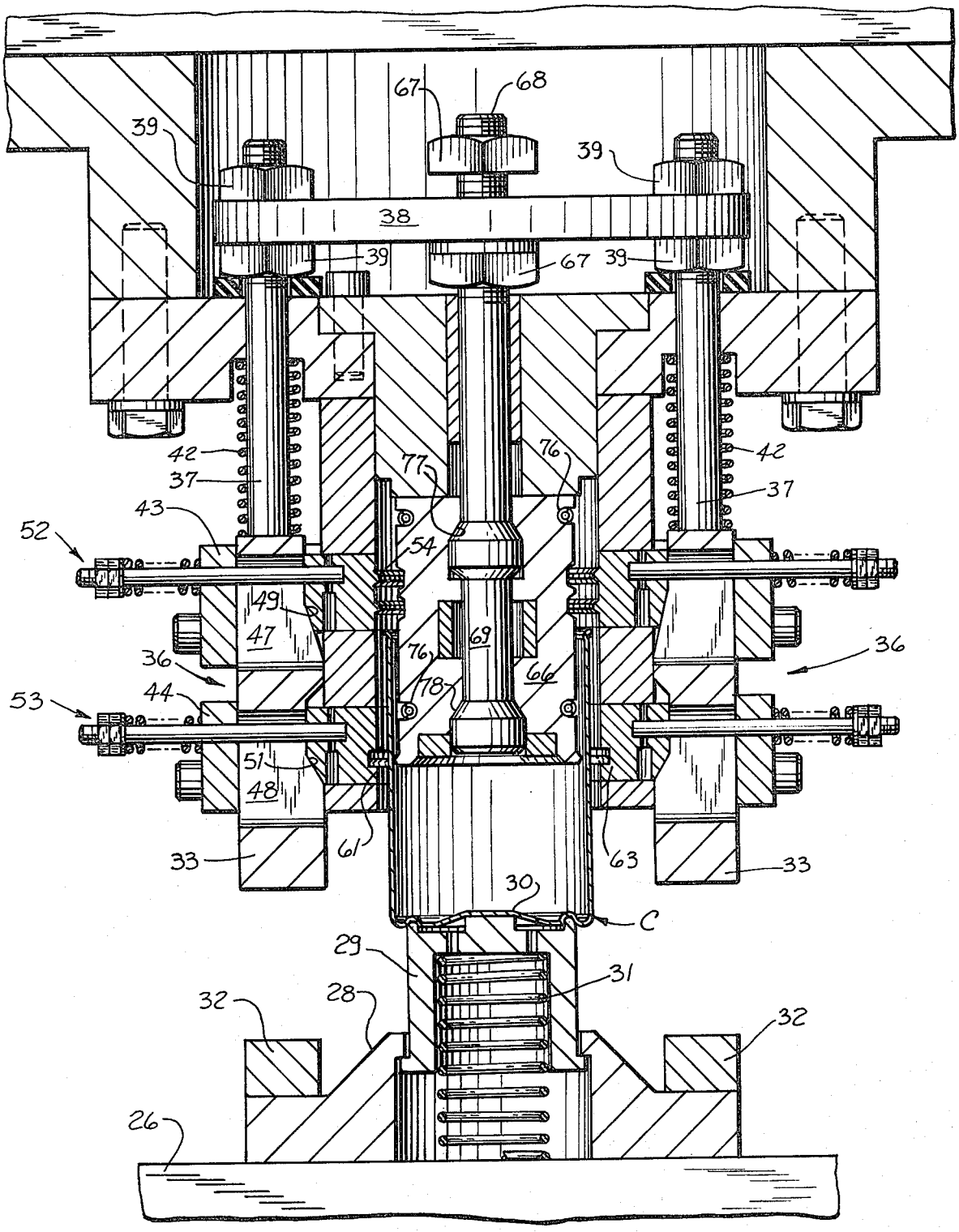
FIG. 8 is a vertical section of FIG. 5 as viewed in the plane represented by the line 8—8.
Figure 9:
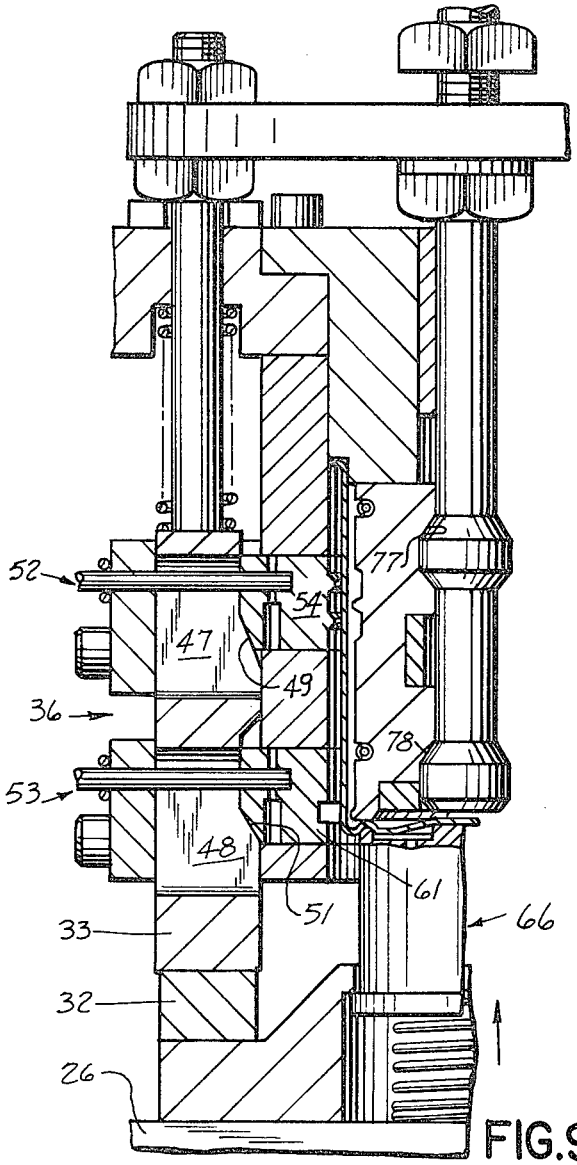
FIG. 9 is a partial view (left side) of the illustration of FIG. 8 showing the can C elevated into working position.

The support 29 is urged upwardly by coil spring 31 and is free to move from a position shown in FIG. 8 to the position shown in FIG. 9.

Exterior cam operating ring 32, secured to socket 28 by bolts 30 is operative upon upward stroke to contact driving heads 33—33 (four in number in the disclosed embodiment) of four exterior cams indicated generally by the reference numeral 36 (FIG. 8) and for convenience in claiming sometimes referred to as cam means.

Exterior cams 36, disposed at 90 intervals (in the disclosed embodiment), are identical so that a description of one cam will serve as a description of others.

Each exterior cam 36 includes a stem or shaft 37 secured to circular crosshead 38 by means of adjusting nuts 39. The shaft 37 is supported by guide 41 and the cam 36, urged downwardly by coil spring 42, is further supported by guides 43 and 44 and spacer 46.

The cams 36 are each formed with upper and lower cam elements 47 and 48 having cam faces 49 and 51, respectively.

The cam elements 47 and 48 operate two sets of segmental dies indicated generally by the reference numerals 52 and 53 in FIG. 9.

Each set of dies comprises 4 die segments such as die segments 54, 56, 57 and 58 of set 52 (see FIGS. 5 and 6) encircling can C and retained in an open or work receiving position by mating springs 59—59.

Die set 53 comprises outer chime bead die segments 61, 62, 63 and 64 (as is most apparent in FIGS. 5 and 7) encircling can C in the same fashion as set 52.

Correspondingly dies segments 61–64 are retained in a work receiving or open position by springs 66—66.

Both die sets 52 and 53 are under control of and are operated by exterior cam means 36 in a manner which will become more apparent when the operation of the disclosed embodiment of the invention is described.

Although the disclosed embodiment of the invention shows four die segments per set operating upon a round can body, it is to be distinctly understood that the various sets of dies, internal and external, may comprise more or less than four segments depending upon the bead configuration desired and the confirmation of the can body.

In addition, the working surfaces of the die segments of a given set must conform generally to the cross-sectional shape of the can body.

The die segments 54, 56, 57 and 58 of set 52, useful in cooperation with a single set of internal die segments indicated generally by the reference numeral 66 in FIG. 8, to form body beads on can C, are in register vertically with die segments 61 through 64 of set 53 which also cooperate with internal die segments 66 to form chime beads on can C.

Thus upward motion of a cam means 36 (see FIGS. 5, 6 and 8) will move cam elements 47 and 48 and thus cam faces 49 and 51 upwardly to drive die segment 54 of die set 52 and die segment 61 of set 53 from their open or work receiving position radially inwardly to a working position.

In otherwords, a die segment of set 52 and a corresponding die segment of set 53 are individual to, but under control of, a given cam means 36.

Figure 3:
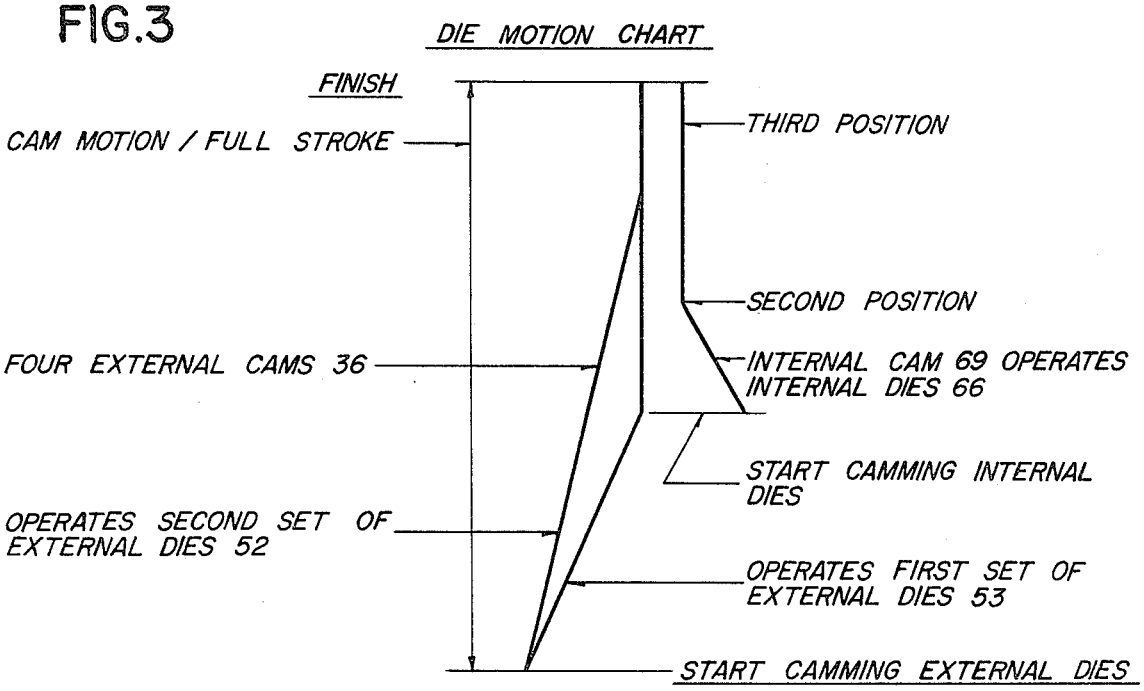
FIG. 3 is a time and motion diagram showing the sequence of cam and die set operation.

As will be apparent when the timing diagram of FIG. 3 is discussed the segments of a given die set operate in unison but each set is timed or programmed separately.

The circular crosshead 38 by virtue of its connection with adjusting nuts 67—67 on stem 68 operates internal cam element 69 to drive the set of internal die segments 66.

For convenience in claiming the internal and external cam elements including the crosshead 38 are referred to collectively as cam means.

Referring again to FIGS. 5, 6, 7 and 8, the set of internal die segments 66, comprising individual segments 71, 72, 73 and 74 held snugly about cam element 69 by coil springs 76—76, define generally a circle in cross-section.

The cam element 69 is formed with identical cams 77—77 operative to engage mating cam faces 78—78 of the die segments effective to drive the segments radially outwardly from the idle position of FIG. 8 to a working position (FIGS. 7 and 11) as the cam element 69 is raised in timed sequence.

The contours formed on the upper end of the internal die segments 71 through 74 and on the external die segments 54, 56, 57 and 58 cooperate in the working position to form body beads on the can C as at 22 in FIG. 1.

Correspondingly the contours formed on the lower end of the internal die segments cooperate with the external die segments 61 through 64 to form chime beads as at 23 in FIG. 1.

OPERATION

The operation of the disclosed embodiment of the invention occurs as follows:

With the metal forming tool in the condition shown in FIG. 8 the can C is positioned upon can support 29 and circular protruberance 25 cooperates with can bottom 30 to center the can. If necessary seat 29 can be depressed against spring 31 to provide clearance for insertion of the can C.

Next, by automatic and timed means not shown, the base 26, socket 28 and thus cam operating ring 32 are moved upwardly from the position shown in FIG. 8 (open or work piece receiving position) to the position of FIG. 9.

Figure 12:
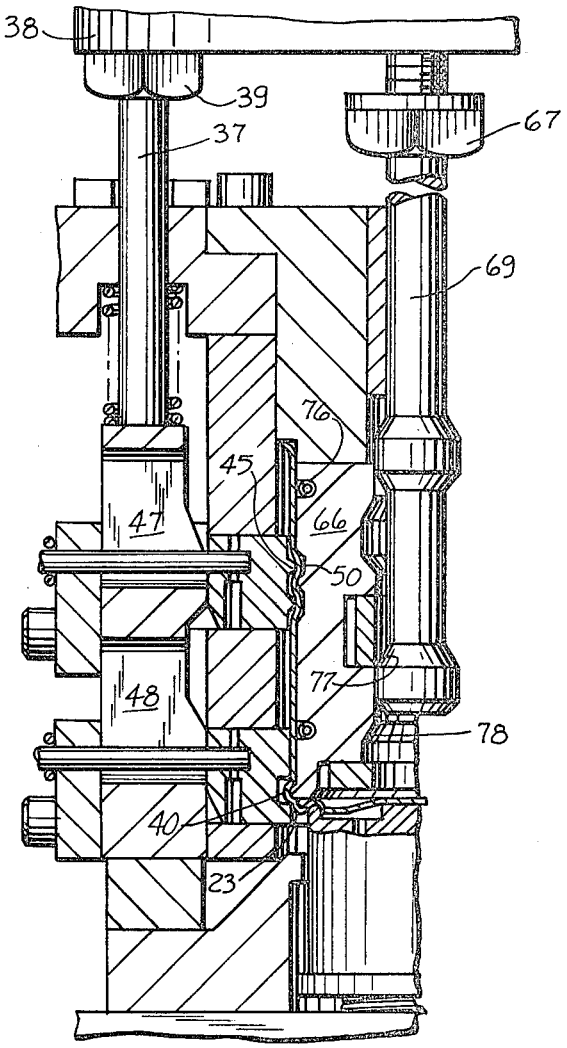
FIG. 12 is a view similar to FIG. 9 showing the upper exterior die segments cooperating with the interior die segments to form body beads.
Figure 10:
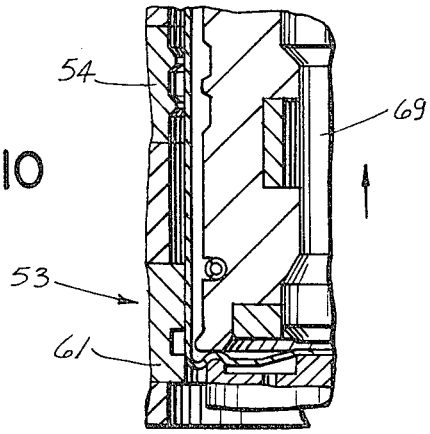
FIG. 10 is a view of a portion of FIG. 9 showing an exterior chime die segment in the operated position.
Figure 11:
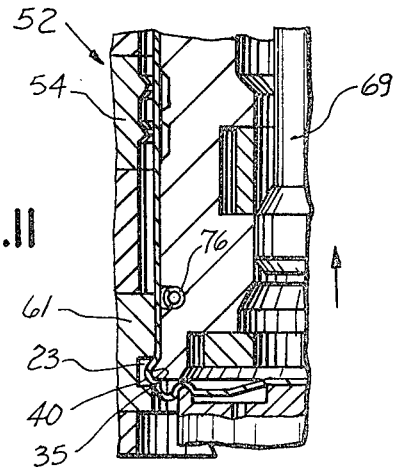
FIG. 11 is similar to FIG. 10 showing the exterior chime die segments and the cooperating (internal) die segments operated to form bottom chime.

At this point the cam operating ring 32 makes a driving connection with each of the heads 33—33 of the four exterior cams 36—36 and the can C is positioned relative to the sets of external dies segments 52 and 53 and the single set of internal die segments 66 so that upon continued upward stroke of the cam operating ring 32 the various die sets will operate in accordance with the timing chart of FIG. 3 to perform work upon the can body as the die segments assume a sequence of positions illustrated in FIGS. 10, 11 and 12.

Referring to FIGS. 3, 9 and 10 continued motion of cam operating ring 32 upwardly after abutment with head 33 is operative drive exterior cams 36—36 upwardly so that cam elements 47 and 48 start camming both sets of external die segments 52 and 53 inwardly toward the can C.

That is, die segments 61, 62 63 and 64 of set 53 and die segments 54, 56, 57 and 58 of set 52 start moving toward the can C.

As is apparent diagrammatically in FIG. 3 and as illustrated in FIG. 8 and 10, the cam faces 49 and 51 of die sets 52 and 53 are so spaced and so contoured that the external die segments labelled 53 (lower or first set) arrive at their working positions first and thereafter remain at rest for the balance of the stroke of the cam means.

Note that while the die set 53 is being driven into working position of FIG. 10 internal cam 69 is idle because of the lost motion connection between nut 67 and crosshead 38 as is most apparent in FIG. 8.

When die set 53 is in working position the lost motion gap is closed (see FIG. 12) and continued upward stroke of the cam means causes crosshead 38 to lift internal cam element 69 starting the internal set of die segments 66 to move outwardly toward the interior of the can to the second position as illustrated in FIG. 12 to form chime bead 23. That is cams 77—77 drive can faces 78—78 to expand the set of internal die segments.

The chime bead results from annular male projection 35 forcing metal into the annular female recess 40.

Note that in the second position as represented by the disposition of die segments in FIG. 11 and as shown diagrammatically in FIG. 3 the external die set 52 is not yet in working position.

Continued upward motion of the cam means brings die set 52 to its working position (third position) as illustrated in FIGS. 3 and 12. At this point the annular male protruberances 45—45 on the die segments 54, 56, 57 and 58 cooperate with annular female recesses 50—50 of internal die segments 71, 72, 73 and 74 to form body beads 22 (FIG. 1) on can C.

Thereafter the cam motion continues from the third position to the completion or finish of the stroke to set the beads in the can body.

In timed sequence the cam means stroke is reversed and the metal forming tool returns to the open position (FIG. 8) under the influence of springs 42—42 and the beaded can is discharged.

Obviously, a wide variety of embodiments of the present invention may be devised without departing from the spirit and scope thereof.

What is claimed is:

1. A press for making a body of a two-piece can from metallic strip of the type wherein a blanking and drawing station is provided to form a cup from said strip and wherein additional forming stations are provided to generate an elongated can body of reduced diameter from said cup, the improvement, an additional station comprising:

(a) a set of internal die segments, each segment having an outer face and an inner face with a first end and a second end and wherein the outer face proximate the first end is provided with a projection and wherein said projections on said segment faces align one with the other to substantially form an annular projection for chime bead embossment and wherein said outer faces of said segments are further contoured to include recessed areas intermediate said first end and said second end for body bead embossment;

(b) a first set and a second set of external die segments disposed around said internal die segments and spaced apart therefrom to define a position for receiving said can body and wherein said external segments are each provided with an inner face and an outer face and wherein said inner face of said segments of said first external set includes a recessed area in confronting relationship with said annular projections on the outer face of said internal set and wherein said inner face of said segments of said second external set include projections in confronting relationship with said intermediately disposed recesses on said outer face of said internal set;

(c) cam means driven by said press and operably connected to said internal and said external die segments to advance said first external set inwardly from an outward receiving position to an inward working position and to advance said internal set outwardly from an inwardly receiving position to an outwardly working position wherein said internal projections are proximate said recesses of said first external set but where said internal set recesses are intermediate said projection of said second external set and to advance said second external set inwardly from an outward receiving position to an inward working position wherein said second external set projections are proximate said internal recesses; and (d) can support seat in vertical alignment with said die segments to advance and retreat in cooperation with said cam means whereby a can body mounted on said support seat is advanced by the stroke of said press into said can receiving position and therein centered and axially supported for chime and body bead embossment.

2. A press as recited in claim 1 wherein said second set of external die segments and said intermediate recessed areas are cooperatively configured to emboss at least one annular body bead on said can body.

* * * * *